US005819153A

United States Patent [19]

Lim

[11] Patent Number: 5,819,153

[45] Date of Patent: Oct. 6, 1998

[54] PAPER FEEDING UNIT FOR ELECTROPHOTOGRAPHIC PRINTING APPARATUS WITH GEAR MECHANISM TO PREVENT UNDESIRABLE PAPER SKEW

[75] Inventor: Kwang-Taek Lim, Kwangmyeong, Rep. of Korea

[73] Assignee: SamSung Electronics Co., Ltd., Suwon, Rep. of Korea

[21] Appl. No.: 858,447

[22] Filed: May 19, 1997

[30] Foreign Application Priority Data

May 18, 1996 [KR] Rep. of Korea ..... 12477/1996

[51] Int. Cl.[6] ..... G03G 15/00

[52] U.S. Cl. ..... 399/388; 399/395; 399/396

[58] Field of Search ..... 399/388, 391, 399/393, 395, 396; 271/9.01, 9.11–9.13, 226, 270

[56] References Cited

U.S. PATENT DOCUMENTS

| | | | |
|---|---|---|---|
| 4,303,234 | 12/1981 | Plum | 271/109 |
| 4,861,012 | 8/1989 | Shimizu | 271/3.02 |
| 4,976,558 | 12/1990 | Kuzuya et al. | 400/615.2 |
| 4,984,778 | 1/1991 | Alexander et al. | 271/117 |
| 5,057,874 | 10/1991 | Miyazaki et al. | 399/396 |
| 5,102,112 | 4/1992 | Takahashi | 271/9.08 |
| 5,189,469 | 2/1993 | Endo | 399/116 |
| 5,226,741 | 7/1993 | Kumazaki et al. | 400/579 |
| 5,362,038 | 11/1994 | Giles et al. | 271/10.16 |
| 5,381,220 | 1/1995 | Acquaviva et al. | 399/367 |
| 5,418,604 | 5/1995 | Nagakura et al. | 399/16 |
| 5,427,462 | 6/1995 | Jackson et al. | 400/579 |
| 5,433,425 | 7/1995 | Kubota et al. | 271/9.12 |
| 5,478,067 | 12/1995 | Requena et al. | 271/3.14 |
| 5,485,990 | 1/1996 | Kato | 271/9.08 |
| 5,501,444 | 3/1996 | Yukimachi et al. | 271/9.13 X |
| 5,524,994 | 6/1996 | Hirano et al. | 400/579 |

*Primary Examiner*—William J. Royer
*Attorney, Agent, or Firm*—Robert E. Bushnell, Esq.

[57] ABSTRACT

A paper feeding unit for an electrophotographic printing apparatus which can prevent print media from being drawn to the right or left during conveyance. The paper feeding unit includes a printing station for printing each sheet of paper; a first feeding unit having a main paper cassette for containing a stack of paper, a first pick-up roller for feeding an uppermost sheet of paper from the main paper cassette to a driving roller, and first and second conveyance rollers which are coactive with the driving roller for conveying each sheet of paper to the printing station; and a second feeding unit having an option cassette for containing a stack of paper, a second pick-up roller for feeding an uppermost sheet of paper from the option cassette, and first and second relay rollers for conveying each sheet of paper fed from the second pick-up roller to the driving roller for conveyance to the printing station, wherein the first relay roller of said second feeding unit exhibits an outer diameter larger than an outer diameter of said second conveyance roller of the first feeding unit in order to prevent paper from being drawn to one side during conveyance.

12 Claims, 4 Drawing Sheets

PAPER FEEDING UNIT FOR ELECTROPHOTOGRAPHIC PRINTING APPARATUS WITH GEAR MECHANISM TO PREVENT UNDESIRABLE PAPER SKEW

CLAIM FOR PRIORITY

This application makes reference to, incorporates the same herein, and claims all benefits accruing under 35 U.S.C. §119 from an application for PAPER FEEDING UNIT FOR ELECTROPHOTOGRAPHIC PRINTING APPARATUS earlier filed in the Korean Industrial Property Office on 18 May 1997, and there duly assigned Ser. No. 12477/1996.

BACKGROUND OF THE INVENTION

1. Technical Field

The present invention relates to a printing apparatus using electrophotography, and more particularly, relates to a paper feeding unit for a printing apparatus for feeding individual sheets of paper separately from a stack of paper to prevent an undesirable skew which often occurs during the conveyance of paper picked up from a paper cassette to an image forming station.

2. Related Art

Electrophotographic developing processes are widely used in computer printers as disclosed, for example, in U.S. Pat. No. 5,485,990 for Image Forming Apparatus issued to Kato, facsimile machines as disclosed in, for example, U.S. Pat. No. 5,189,469 for Recording Device issued to Endo, and photocopiers as disclosed, for example, in U.S. Pat. No. 5,102,112 for Paper Feeding Device For Image Forming Equipment issued to Takahashi, in order to produce images on recording media in response to video signals. A common example of an electrophotographic printing apparatus is a laser beam printer which prints images on individual sheet of paper through a series of electrostatic image-forming steps. Generally, the process of electrostatic image forming includes charging a photosensitive drum to a substantially uniform potential so as to sensitize the surface thereof. The charged portion of the photosensitive drum is exposed to a light image to record an electrostatic latent image on its surface. The latent image is then developed by applying toner from a developing unit onto the photosensitive drum which is subsequently transferred and fixed on a recording paper which is fed from a paper feeding unit. When a toner image is fixed on a recording paper, the toner image is first heated and fused onto the recording paper, and then naturally cooled so that it is fixed onto the recording paper.

A significant problem that frequently occurs in such an image forming apparatus is the skew of paper in a paper feeding unit. Paper skew occurs mainly due to the misalignment of the top edge of the sheet of paper and the first line of print contained thereon when the paper is drawn to one side during the conveyance of paper picked up from a paper cassette to a printing assembly. Generally, paper skew frequently occurs in a multi-stage feeding unit in which paper picked up from a second paper cassette passes through relay rollers to convey rollers. A small amount of skew between the paper and the print will cause the printing to appear crooked. Larger amounts of skew may cause buckling of paper, resulting in uneven print quality or jamming of the paper within the printer. Accordingly, it is desirable to prevent or minimize the amount of skew between the paper and the printing assembly once the paper is picked up from the paper cassette. Examples of conventional paper skew correction techniques are disclosed in U.S. Pat. No. 4,303, 234 for Deskewing Document feed Tray issued to Plum, U.S. Pat. No. 4,984,778 for Sheet Feeder With Skew Control issued to Alexandria et al., U.S. Pat. No. 5,226,741 for Printing Apparatus And Method Of Forward And Reverse Sheet Feeding To Prevent Skewing issued to Kumazaki, U.S. Pat. No. 5,362,038 for Sheet Feeder For Computer Driven Printer issued to Giles et al., U.S. Pat. No. 5,418,604 for Image Forming Method And Apparatus With Automatic Skew Control issued to Nagakura et al., U.S. Pat. No. 5,427,462 for Method And Apparatus For Paper Control And Skew Correction In A Printer issued to Jackson et al., U.S. Pat. No. 5,524,994 for Paper Skew Removal Apparatus And A Printer Using The Same issued to Hirano. While the conventional skew correction techniques are effective in their own rights, I have noted that complex paper feeding mechanisms are required which increase the production cost and time necessary to pass the paper through the printer.

SUMMARY OF THE INVENTION

Accordingly, it is therefore an object of the present invention to provide a paper feeding unit for an electrophotographic printing apparatus which prevents the possibility of paper skew.

It is another object to provide a paper feeding unit for an electrophotographic printing apparatus which is simple and may be implemented economically.

It is still another object to provide a paper feeding unit for an electrophotographic printing apparatus which assures optimal operating condition for both a main cassette feeder and a second cassette feeder.

It is further an object to provide a paper feeding unit for an electrophotographic printing apparatus which can prevent frictional pressures due to paper slippage.

These and other objects of the present invention can be achieved by an electrophotographic printing apparatus which includes a printing station for printing each sheet of paper; a first feeding unit having a main paper cassette for containing a stack of paper, a first pick-up roller for feeding an uppermost sheet of paper from the main paper cassette to a driving roller, and first and second conveyance rollers which are coactive with the driving roller for conveying each sheet of paper to the printing station; and a second feeding unit having an option cassette for containing a stack of paper, a second pick-up roller for feeding an uppermost sheet of paper from the option cassette, and first and second relay rollers for conveying each sheet of paper fed from the second pick-up roller to the driving roller for conveyance to the printing station, wherein the first relay roller of said second feeding unit exhibits an outer diameter larger than an outer diameter of said second conveyance roller of the first feeding unit in order to prevent paper from being drawn to one side during conveyance.

The present invention is more specifically described in the following paragraphs by reference to the drawings attached only by way of example.

BRIEF DESCRIPTION OF THE DRAWINGS

A more complete appreciation of the present invention, and many of the attendant advantages thereof, will become readily apparent as the same becomes better understood by reference to the following detailed description when considered in conjunction with the accompanying drawings in which like reference symbols indicate the same or similar components, wherein.

DETAILED DESCRIPTION OF THE PREFERRED EMBODIMENT

Figure 1:
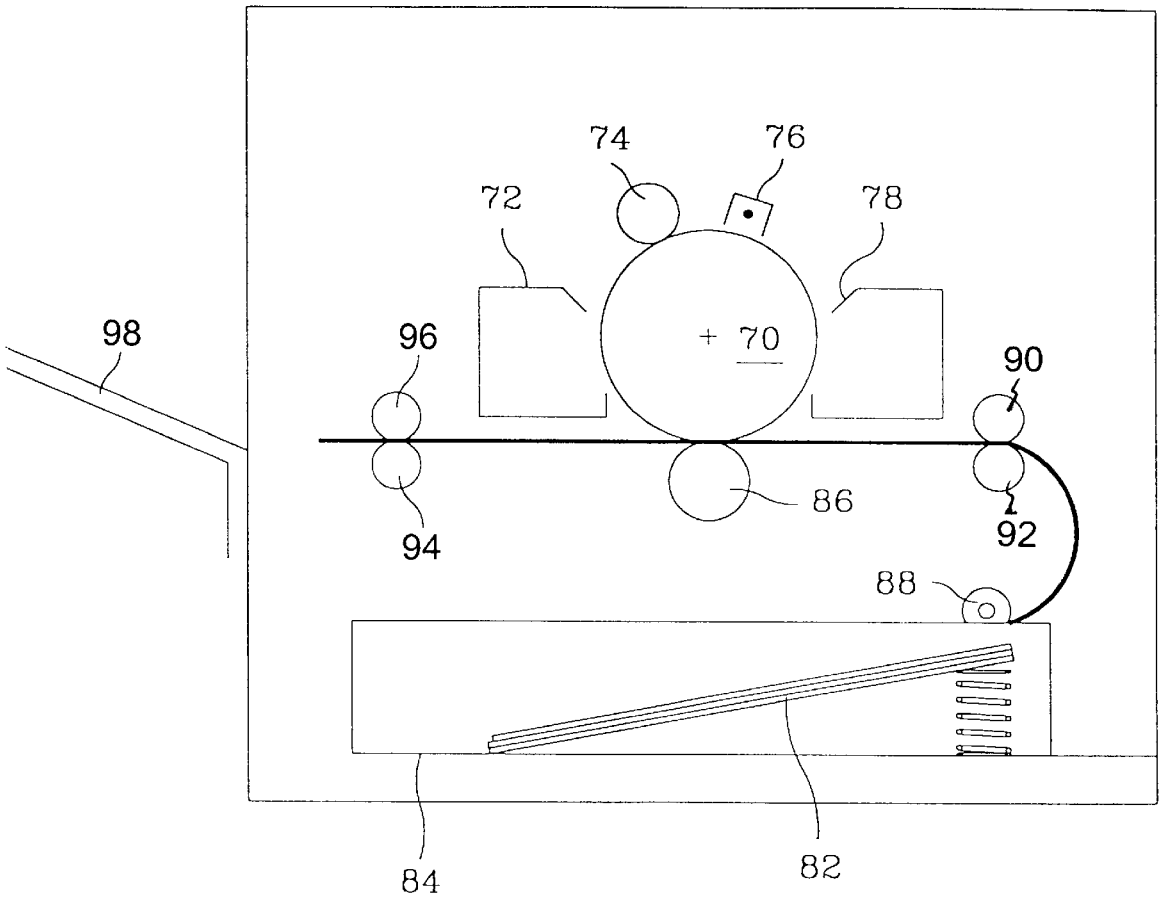
FIG. 1 BACKGROUND ART
FIG. 1 illustrates a contemporary printing apparatus using electrophotography.

Referring now to the drawings and particularly to FIG. 1, which illustrates a contemporary image forming apparatus such as a laser beam printer using an electrophotographic process. The laser beam printer includes a photosensitive drum 70, a cleaner 72, a charger 74, a scanner 76, a developer 78, a transfer roller 86, a pick-up roller 88 for picking up paper 82 from a stack of paper contained in a paper cassette 84, a pair of convey rollers 90, 92 for conveying individual sheets of paper into a printing station, a fixing unit comprising a pair of coactive rollers which consists of a fuser roller 94 and a pressure roller 96, and a discharge tray 98.

As shown in FIG. 1, the charger 74, creates a uniform static electric charge on the outer surface of the photosensitive drum 70. The laser scanner 76 generates a laser beam corresponding to a time-serial electrical pixel signal of image information input from an original image reading unit (not illustrated), and traces the image on the outer surface of photosensitive drum 70 so as to create a latent image on the surface of the photosensitive drum 70. The latent image is converted to a toner image by the developer 78.

The electrophotographic process begins when the pickup roller 88, picks up the uppermost sheet of paper 82 loaded in the paper cassette 84. The conveyer rollers 90 and 92 convey the paper to registration rollers (not shown), where the paper is aligned. A transfer charge is applied to the outer surface of the photosensitive drum 70 by the transfer roller 86, to transfer the toner image onto the paper. After the toner image is transferred onto the paper, the cleaner 72 removes any residual toner on the surface of the photosensitive drum 70, and the fixing unit fuses the toner image to the paper. The fixing unit includes a fuser roller 94 and a pressure roller 96. Fuser roller 94 is heated by a heat lamp to fuse the toner image to the paper 82.

The laser beam printer as shown in FIG. 1 also has sensors (not shown) which monitor the operating state of the printer such as the paper conveyance state, the opening or the closing of the printer's cover. Generally, a first sensor is located to monitor the status of the paper that is fed from the paper cassette 84. A second sensor is located in the paper path between convey rollers 90, 92 and registration rollers (not shown) to monitor the status of the paper that is transferred to the registration rollers. A third sensor is mounted in the paper output path between the fixing unit and the discharge tray 98 to monitor the state of paper discharged to the discharge tray 98.

Figure 2:
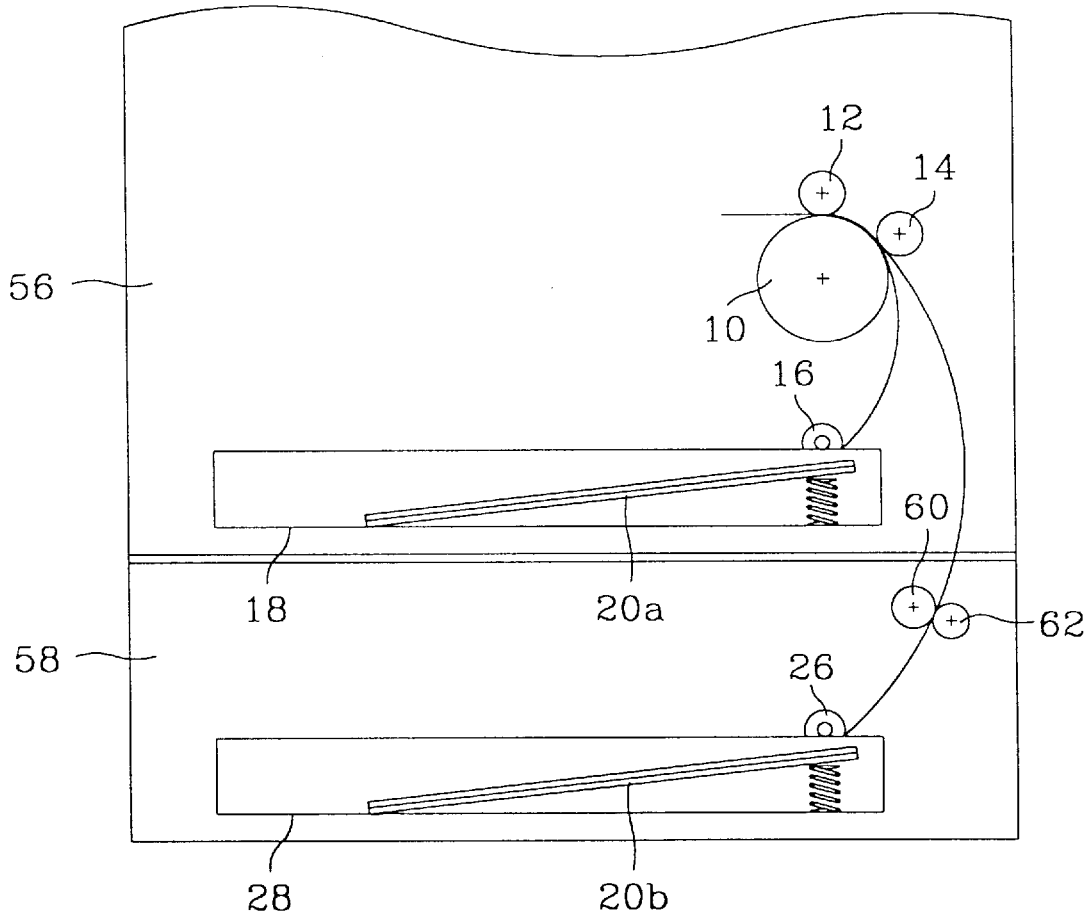
FIG. 2 BACKGROUND ART
FIG. 2 illustrates a paper feeding unit of the contemporary printing apparatus.

FIG. 2 illustrates a paper feeding unit of a contemporary image forming apparatus which comprises a main cassette feeder 56 and a second cassette feeder 58. A main paper cassette 18 containing paper 20*a* is inserted in a cassette insertion slot of the main cassette feeder 56. A first pickup roller 16 is located at one end of main paper cassette 18 to feed paper 20*a* to a driving roller 10. Driving roller 10, first conveyance roller 12, and second conveyance roller 14 are located over one side of first pickup roller 16 so as to convey papers 20*a* to a transfer roller 86.

The second cassette feeder 58 is installed under the main cassette feeder 56, where an option cassette 28 containing paper 20*b* is inserted into a cassette insertion slot of second cassette feeder 58. A second pickup roller 26 is located in an upper portion of option cassette 28, thus feeding papers 20*b* to a relay roller. A first relay roller 60 and a second relay roller 62 are coactively rotated over one side of second pickup roller 26 so as to convey papers 20*b* to driving roller 10 and second conveyance roller 14. First relay roller 60 conveys papers 20*b* at the same speed as the speed at which the second conveyance roller 14 conveys paper 20*b*.

The operating state of the paper feeding unit is divided into main cassette feeder's feeding paper 20*a*, and second cassette feeder's feeding paper 20*b*.

The steps for conveying paper 20*a* with the main cassette feeder 56 as described with reference to FIG. 1 will be omitted for the sake of brevity. The steps for conveying papers 20*b* with the second cassette feeder 58 are now described as follows.

Second pickup roller 26 rotates in a counterclockwise direction, driven by a separate driving motor different from a main motor, and conveys the uppermost sheet of papers 20*b* from option cassette 28 to first relay roller 60 and second relay roller 62. When the top edge of paper 20*b* is held between first relay roller 60 and second relay roller 62, second pickup roller 26 begins to idle with a clutch, and papers 20*b* continues moving to the upper portion.

First relay roller 60 and second relay roller 62 convey papers 20*b* to driving roller 10 and second conveyance roller 14. Second relay roller 60 has a linear velocity that is the same as the linear velocity of the second conveyance roller 14. Paper 20*b* is conveyed to the transfer roller by driving roller 10 and first conveyance roller 12.

Since the papers conveyance speed of second cassette feeder 58 is similar to that of main cassette feeder 56, paper slides on the papers guide without curling between first and second relay rollers 60 and 62, of the second cassette feeder 58, and driving roller 10 and second conveyance roller 14 of the main cassette feeder 56. Accordingly, when paper slippage occurs between first relay roller 60 and second relay roller 62, and frictional force increases between driving roller 10 and second conveyance roller 14, paper skew problems occur (i.e. paper's being drawn to one side during conveyance) to deteriorate the print quality of an image.

Figure 3:
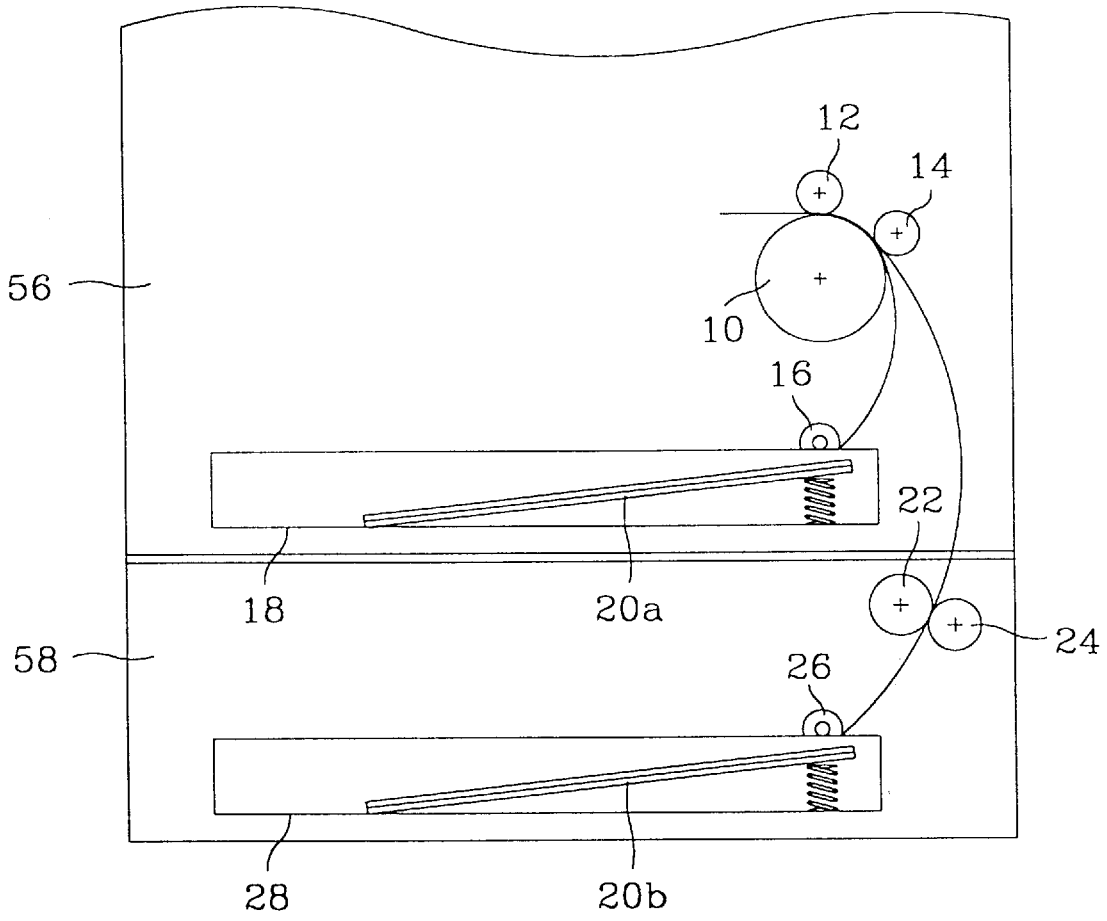
FIG. 3 illustrates a paper feeding unit for an electrophotographic printing apparatus constructed according to the principles of the present invention.

Turning now to FIG. 3 which illustrates a paper feeding unit for a printing apparatus constructed according to the principles of the present invention. As shown in FIG. 3, a main paper cassette 18 containing a stack of paper 20*a*, is inserted into the cassette insertion slot of a main cassette feeder 56. A first semicircular-shaped pickup roller 16 is located at one end of main paper cassette 18, and delivers paper 20*a* from main paper cassette 18 to a driving roller 10. Driving roller 10, a first conveyance roller 12, and a second conveyance roller 14 are installed over first pickup roller 16 so as to convey paper 20*a* to a transfer roller.

A second cassette feeder 58 is included under main cassette feeder 56 to increase paper capacity. An option cassette 28 containing a stack of paper 20*b* is inserted into the cassette insertion slot of second cassette feeder 58. A second semicircular pickup roller 26 is located at the upper end of an option cassette 28 to deliver paper 20*b* from option cassette 28 to a relay roller. A first relay roller 22 and a second relay roller 24 are located to touch each other over second pickup roller 26 in order to convey paper 20*b* to driving roller 10 and second conveyance roller 14. First relay roller 22 has a circumference diameter larger than that of the second conveyance roller 14 in order to prevent paper 20*b* from being drawn to one side during conveyance and to prevent frictional pressure due to paper slippage.

The operation of the printing apparatus having a paper feed unit incorporated therein and constructed according to the present invention will now be described hereinbelow.

When the paper is to be conveyed from the main cassette feeder 56, the first pickup roller 16 which rotates in a counterclockwise direction and is powered by a main motor, picks up the uppermost sheet of paper 20*a* from main paper cassette 18 to driving roller 10 and second conveyance roller 14 When the top edge of paper 20*a* is grabbed by driving roller 10 and second conveyance roller 14, the first pickup roller 16 runs idle, and paper 20*a* continues moving upward. Paper 20*a* is conveyed to the transfer roller, where printing begins, by driving roller 10 and first conveyance roller 12.

Figure 4:
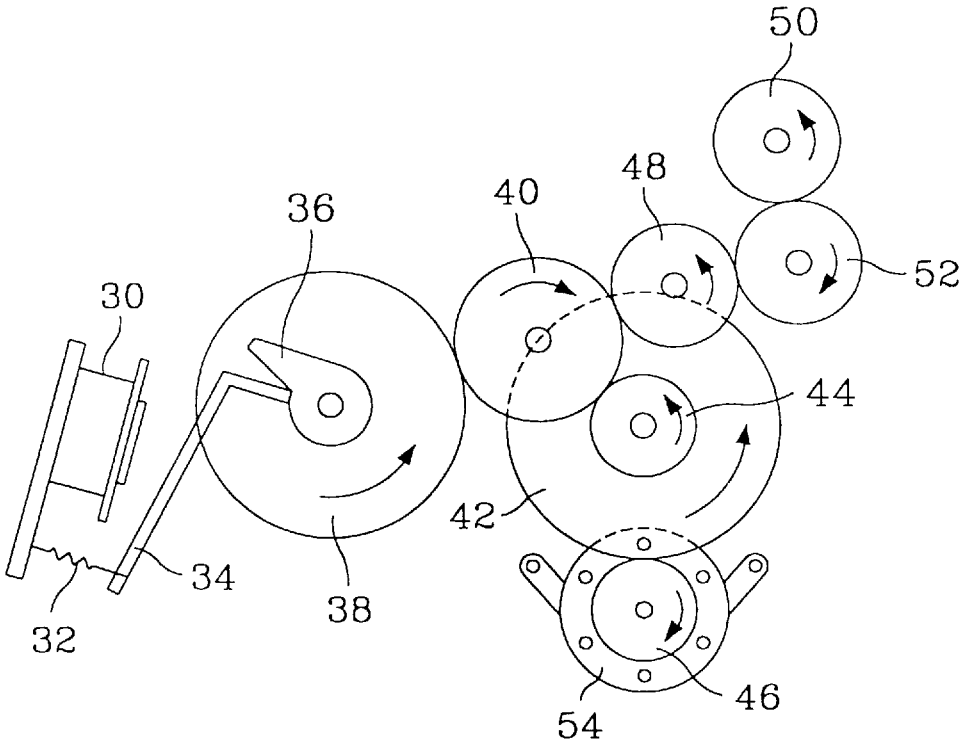
FIG. 4 illustrates a gear mechanism of a second cassette feeder constructed according to the present invention.

The steps of conveying papers 20*b* with second cassette feeder 58 will be described referring to FIGS. 3 and 4.

Driving gear 46 which is powered by an extra driving motor 54 independent from the main motor, rotates in a clockwise direction and meshes with a second idle gear 42 which rotates in a counterclockwise direction. A third idle gear 44, coaxial with and driven by gear 42, meshes with first idle gear 40 which then rotates in a clockwise direction. First idle gear 40 meshes with a pickup roller gear 38 that then rotates in a counterclockwise direction.

A fourth idle gear 48 rotates in a counterclockwise direction meshing with first idle gear 40. Fourth idle gear 48 meshes with fifth idle gear 52, which then rotates in a clockwise direction. Fifth idle gear 52 meshes with a first relay roller gear 50, which then rotates in a counterclockwise direction. First relay roller gear 50 drives first relay roller 22 in a counterclockwise direction.

Pickup roller gear 38 idles when a clutch 36 is operated. When a moment a lever 34 is separated from clutch 36 using an electric solenoid 30, the driving force is transferred to second pickup roller 26. Subsequently, second pickup roller 26 rotates in a counterclockwise direction to move the uppermost sheet of paper 20*b* from option cassette 28 to first and second relay rollers 22 and 24. When the top edge of paper 20*b* is inserted between first and second relay rollers 22 and 24, clutch 36 is operated by lever 34 and solenoid 30 so that second pickup roller 26 idles again while paper 20*b* continues to move upward to the transfer roller direction.

First relay roller gear 50 delivers paper 20*b* to driving roller 10 and second conveyance roller 14. Since the outer diameter of first relay roller 22 is larger than that of second conveyance roller 14, first relay roller 22 has a linear velocity higher than second conveyance roller 14's. Driving motor 54, installed in second cassette feeder 58, produces a driving force larger than that of the main motor, and since first relay roller 22 has a linear velocity higher than the linear velocity of the second conveyance roller 14, paper 20*b* curls when it is delivered to driving roller 10 and second conveyance roller 14. Driving roller 10 and first conveyance roller 12 convey paper 20*b* to the transfer roller so that printing is performed.

The inventive paper feeding unit for an electrophotographic image forming apparatus includes a first relay roller for a second cassette feeder that has a larger diameter than the diameter of a second conveyance roller. The first relay roller also rotates at a higher linear velocity than that of the second conveyance roller. Thus, paper curls when it slides in a paper guide between the first relay roller and second conveyance roller, thus preventing frictions pressure from being created by paper slippage. In addition, the paper feeding unit of the present invention advantageously prevents the paper skew problems and enhances the print quality of an image.

While there have been illustrated and described what are considered to be preferred embodiments of the present invention, it will be understood by those skilled in the art that various changes and modifications may be made, and equivalents may be substituted for elements thereof without departing from the true scope of the present invention. In addition, many modifications may be made to adapt a particular situation to the teaching of the present invention without departing from the central scope thereof. Therefore, it is intended that the present invention not be limited to the particular embodiment disclosed as the best mode contemplated for carrying out the present invention, but that the present invention includes all embodiments falling within the scope of the appended claims.

What is claimed is:

1. An image forming apparatus, comprising:

a printing station for printing each sheet of paper;

a first feeding unit having a main paper cassette for containing a stack of paper, a first pick-up roller for feeding an uppermost sheet of paper from said main paper cassette to a driving roller, and first and second conveyance rollers which are coactive with the driving roller for conveying each sheet of paper to said printing station; and a second feeding unit having an option cassette for containing a stack of paper, a second pick-up roller for feeding an uppermost sheet of paper from said option cassette, and first and second relay rollers for conveying each sheet of paper fed from the second pick-up roller to said driving roller for conveyance to said printing station, said first relay roller of said second feeding unit exhibiting an outer diameter larger than an outer diameter of said second conveyance roller of said first feeding unit to prevent paper skew occurring during conveyance of the paper to said printing station.

2. The image forming apparatus of claim 1, further comprising coil springs installed on each side of said second relay roller so that said second relay roller contacts said first relay roller with a predetermined pressure.

3. The image forming apparatus of claim 1, further comprised of said first relay roller of said second feeding unit rotating with a linear velocity higher than a linear velocity of said second conveyance roller of said first feeding unit to prevent said paper skew.

4. The image forming apparatus of claim 1, further comprised of said second feeding unit including a motor for generating torque greater than a main motor of said first feeding unit to rotate said first relay roller at a linear velocity higher than a linear velocity of said second conveyance roller of said first feeding unit.

5. The image forming apparatus of claim 2, further comprised of said second feeding unit including a driving motor for generating a greater torque than a main motor of said first feeding unit to rotate said first relay roller at a linear velocity higher than a linear velocity of said second conveyance roller of said first feeding unit.

6. An image forming apparatus, comprising:

a printing station for printing each sheet of paper;

a first feeding unit having a main paper cassette for containing a stack of paper, a first pick-up roller for feeding an uppermost sheet of paper from said main paper cassette to a driving roller, and first and second conveyance rollers which are coactive with the driving roller for conveying each sheet of paper to said printing station; and a second feeding unit having an option cassette for containing a stack of paper, a second pick-up roller for feeding an uppermost sheet of paper from said option cassette, and first and second relay rollers for conveying each sheet of paper fed from the second pick-up roller to said driving roller for conveyance to said printing station, said first relay roller of said second feeding unit being driven at a linear velocity higher than a linear velocity of said second conveyance roller of said first feeding unit to prevent the paper from being drawn to one side during conveyance.

7. The image forming apparatus of claim 4, further comprised of said second feeding unit including a driving motor for generating a greater torque than a main motor of said first feeding unit to rotate said first relay roller at the linear velocity higher than the linear velocity of said second conveyance roller.

8. An image forming apparatus, comprising:

a main body including a printing station for printing each sheet of paper;

a first feeding unit having a feeding system to feed each sheet of paper from a stack of paper contained in a main paper cassette toward said printing station of said main body, and separately connected with said main body by a gear system which drives a first pick-up roller to feed each sheet of paper from said main paper cassette, and a driving roller which are coactive with first and second conveyance rollers to convey each sheet of paper to said printing station; and a second feeding unit having a feeding system to feed each sheet of paper from a stack of paper contained in an option cassette toward said printing station of said main body, and separately connected with said main body by a gear system which drives a second pick-up roller to feed each sheet of paper from said option cassette, and first and second relay rollers to convey each sheet of paper fed from the second pick-up roller to said driving roller of said first feeding unit for conveyance to said printing station, said first relay roller of said second feeding unit exhibiting an outer diameter larger than an outer diameter of said second conveyance roller of said first feeding unit to prevent paper skew occurring during conveyance of the paper to said printing station.

9. The image forming apparatus of claim 8, further comprising coil springs installed an each side of said second relay roller so that said second relay roller contacts said first relay roller with a predetermined pressure.

10. The image forming apparatus of claim 8, further comprised of said first relay roller of said second feeding unit rotating with a linear velocity higher than a linear velocity of said second conveyance roller of said first feeding unit to prevent said paper skew.

11. The image forming apparatus of claim 10, further comprised of said second feeding unit including a motor for generating torque greater than a main motor of said first feeding unit to rotate said first relay roller at the linear velocity higher than the linear velocity of said second conveyance roller.

12. The image forming apparatus of claim 8, further comprised of said first relay roller of said second feeding unit driven by a main motor to rotate with a linear velocity higher than a linear velocity of said second conveyance roller of said first feeding unit driven by a separate motor to prevent said paper skew.

* * * * *